US008985183B2

(12) United States Patent
Terry

(10) Patent No.: US 8,985,183 B2
(45) Date of Patent: Mar. 24, 2015

(54) MESH SCREEN TENSIONER AND RELATED METHOD

(71) Applicant: Kevin Terry, Miami, FL (US)

(72) Inventor: Kevin Terry, Miami, FL (US)

( * ) Notice: Subject to any disclaimer, the term of this patent is extended or adjusted under 35 U.S.C. 154(b) by 158 days.

(21) Appl. No.: 13/651,547

(22) Filed: Oct. 15, 2012

(65) Prior Publication Data

US 2013/0092334 A1 Apr. 18, 2013

Related U.S. Application Data

(60) Provisional application No. 61/546,728, filed on Oct. 13, 2011.

(51) Int. Cl.

| | |
|---|---|
| ***A47G 5/00*** | (2006.01) |
| ***E06B 9/52*** | (2006.01) |
| ***E06B 9/24*** | (2006.01) |

(52) U.S. Cl.

CPC .... *E06B 9/52* (2013.01); *E06B 9/24* (2013.01)
USPC ..... 160/378; 160/371; 160/380

(58) Field of Classification Search

CPC ..... E06B 9/52; E06B 9/01; E06B 9/02; E06B 3/285; B44C 7/022; D05C 1/02; D05C 3/00; D05C 3/08
USPC ..... 160/371, 380, 378, 402, 399, 391, 392, 160/395; 38/102, 102.91, 102.1
See application file for complete search history.

(56) References Cited

U.S. PATENT DOCUMENTS

| | | | | |
|---|---|---|---|---|
| 2,283,574 | A * | 5/1942 | Pillsbury | 160/380 |
| 2,335,361 | A * | 11/1943 | Schiller | 160/395 |
| 2,417,711 | A * | 3/1947 | Smith et al. | 160/353 |
| 2,498,716 | A * | 2/1950 | Seide | 160/378 |
| 3,341,013 | A * | 9/1967 | Moulton | 209/403 |
| 3,422,554 | A * | 1/1969 | Prinzhorn | 38/102.1 |
| 3,485,165 | A * | 12/1969 | Hughes | 101/127.1 |
| 3,962,805 | A * | 6/1976 | Hamu | 38/102.5 |
| 4,232,310 | A * | 11/1980 | Wilson | 340/550 |
| 6,125,910 | A * | 10/2000 | Pepperell et al. | 160/371 |
| 6,802,357 | B2 * | 10/2004 | Taylor et al. | 160/371 |
| 6,892,787 | B1 * | 5/2005 | Stretch | 160/371 |
| 7,293,378 | B2 * | 11/2007 | Bihr | 38/102.91 |
| 7,537,043 | B2 * | 5/2009 | Veivers et al. | 160/380 |
| 7,810,545 | B2 * | 10/2010 | Bernardi | 160/328 |
| 7,934,350 | B2 * | 5/2011 | Koutsoukos | 52/656.7 |
| 8,191,606 | B2 * | 6/2012 | Edlin | 160/378 |
| 8,347,939 | B2 * | 1/2013 | Brabeck et al. | 160/380 |
| 2012/0073771 | A1 * | 3/2012 | Dickison et al. | 160/395 |

* cited by examiner

*Primary Examiner* — Katherine Mitchell
*Assistant Examiner* — Johnnie A Shablack
(74) *Attorney, Agent, or Firm* — Allen, Dyer, Doppelt, Milbrath & Gilchrist

(57) ABSTRACT

The invention relates to a screen tensioning system having a mesh screen and a U-shaped channel that engages an edge of the mesh screen. A clamp engages the U-shaped channel and the mesh screen. A frame having a substantially H-shaped cross section, wherein parallel side members converge to define a longitudinal slot permit the mesh screen to extend through the longitudinal slot, yet the clamp remains secured within the frame. A plurality of fasteners secure the clamp to the frame and are tightened to apply varying degrees of local tension to the screen. Preferably, no fasteners are used to secure the screen to the clamp.

8 Claims, 4 Drawing Sheets

MESH SCREEN TENSIONER AND RELATED METHOD

CROSS-REFERENCE TO RELATED APPLICATION

This application seeks priority to U.S. Provisional Patent Application Ser. No. 61/546,728 filed on Oct. 13, 2011 entitled "Mesh Screen Tensioner Assembly," the contents of which are incorporated by reference herein.

FIELD OF THE INVENTION

The present invention relates to screen assemblies. More specifically, the invention teaches an assembly to secure and provide tension to a mesh screen installed in a door, window, or general screen frame and related methods.

BACKGROUND

Screen mesh is a material commonly stretched between wooden or metal frames, and is designed to cover window or door openings. Screen mesh is also used to enclose areas, such as decks and swimming pools. The primary purposes of these assemblies is generally to keep debris, insects, animals, and ultraviolet rays out of the areas protected by the screen mesh, while allowing light into the same area. Some screen mesh, however, is constructed of relatively strong material, such as stainless steel, and is installed to provide security and protection from intruders, dynamic impact, and knife shear.

The primary role or purpose of these screens varies based upon the geographic area. For example, homes situated in regions with large mosquito populations typically utilize screens on all operable windows (and optionally doors). Areas with large amounts of sun may employ screens to occlude light and limit harmful UV rays past the screen. Security screen is used in regions that routinely experience harsh weather events, such as tropical storms and hurricanes. Security screen is also used to protect businesses and residences from unwanted intruders.

Security screens are almost universally constructed with the use of frame assemblies. These frame assemblies can rest within a door or window opening so that the screen mesh spans across the opening, utilizing the frame as a physical attachment point. Similarly, areas such as porches and pools often have large framed structures that define wall and ceiling frames that support mesh screen.

Despite the popularity of mesh screens, there is a need in the art of frame assemblies for a more secure design that allows greater function in the event of intrusion or severe weather events. Additionally, steel mesh is susceptible to galvanic corrosion from contact with fasteners and frames made from different metals, such as aluminum. Additionally, maintaining and adjusting tension of screen panels is often difficult. Improvement in the field is necessary.

SUMMARY OF THE INVENTION

The following invention provides a frame assembly for a more robust and durable design that helps more properly secure mesh screen to a window or door. Moreover, the instant invention provides a more adjustable frame assembly which allows regions of varying screen tension to be adjusted upon installation. Additionally, by eschewing the use of fasteners that protrude through the steel mesh, deterioration due to galvanic corrosion is eliminated.

The invention contemplates a screen tensioning system having a mesh screen and a U-shaped channel that engages an edge of the mesh screen. A clamp engages the U-shaped channel and the mesh screen, and the clamp defines a slot having a shape and dimension for the mesh screen to extend through the slot, yet is too small to allow the U-shaped channel to pass. A frame that has two substantially parallel side members and a connecting member joining the two substantially parallel side members forms a substantially H-shaped cross section. Additionally, the two substantially parallel side members converge on a first end of the frame to define a longitudinal slot having a size and dimension to permit the mesh screen to extend through the longitudinal slot. There is a plurality of holes in the connecting member. A plurality of fasteners passes through the holes in the connecting member to engage the clamp. The fasteners are tightened in order to apply tension to the screen.

In one embodiment, the edge of the mesh is secured with an adhesive, which can optionally be a metal epoxy. The fasteners to tension the screen or to close the clamp may be machine screws.

In a related embodiment, a clamp defines a plurality of slits that pass substantially through the clamp, the plurality of slits having an orientation perpendicular to a long axis of the clamp. This allows the clamp to be easily deformed so that tension may be differentially applied along the length of the screen.

In another embodiment, a screen tensioning system comprises a mesh screen having a plurality of edges each edge having a thickness greater than a thickness of a central region of the mesh screen. Additionally, a plurality of clamps securely engages each one of the plurality of edges. A substantially rectangular frame assembly has four internal edges that each securely engage one of the plurality of clamps, wherein the screen is secured within the frame assembly. Alternatively, a channel may be affixed to each one of the plurality of edges to provide a greater area for the clamp to engage, which may be accomplished with epoxy. Fasteners with the frame engage the clamps and frame to provide tension to the screen.

The invention also contemplates a method of securing a security screen to a frame. The method comprises the steps of: securing an edge of a security screen to a U-shaped channel extending substantially a length of the edge of the security screen; clamping the U-shaped channel in a clamp assembly that is substantially coextensive with the U-shaped channel; sliding the clamp assembly into a frame member having a size and dimension to entrap the clamp assembly; securing the clamp assembly to the frame member; and applying tension to the screen.

In another embodiment of the method, an adhesive, preferably, is used to secure the edge of the security screen to the U-shaped channel. In related embodiments, a plurality of metal fasteners engages the clamp to securely close the clamp and to also secure the clamp assembly to the frame member.

A related method of securing a security screen to a frame further comprises the step of providing tension to the screen by tightening at least some of the plurality of metal fasteners. This tension may be varied along the length of the screen.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
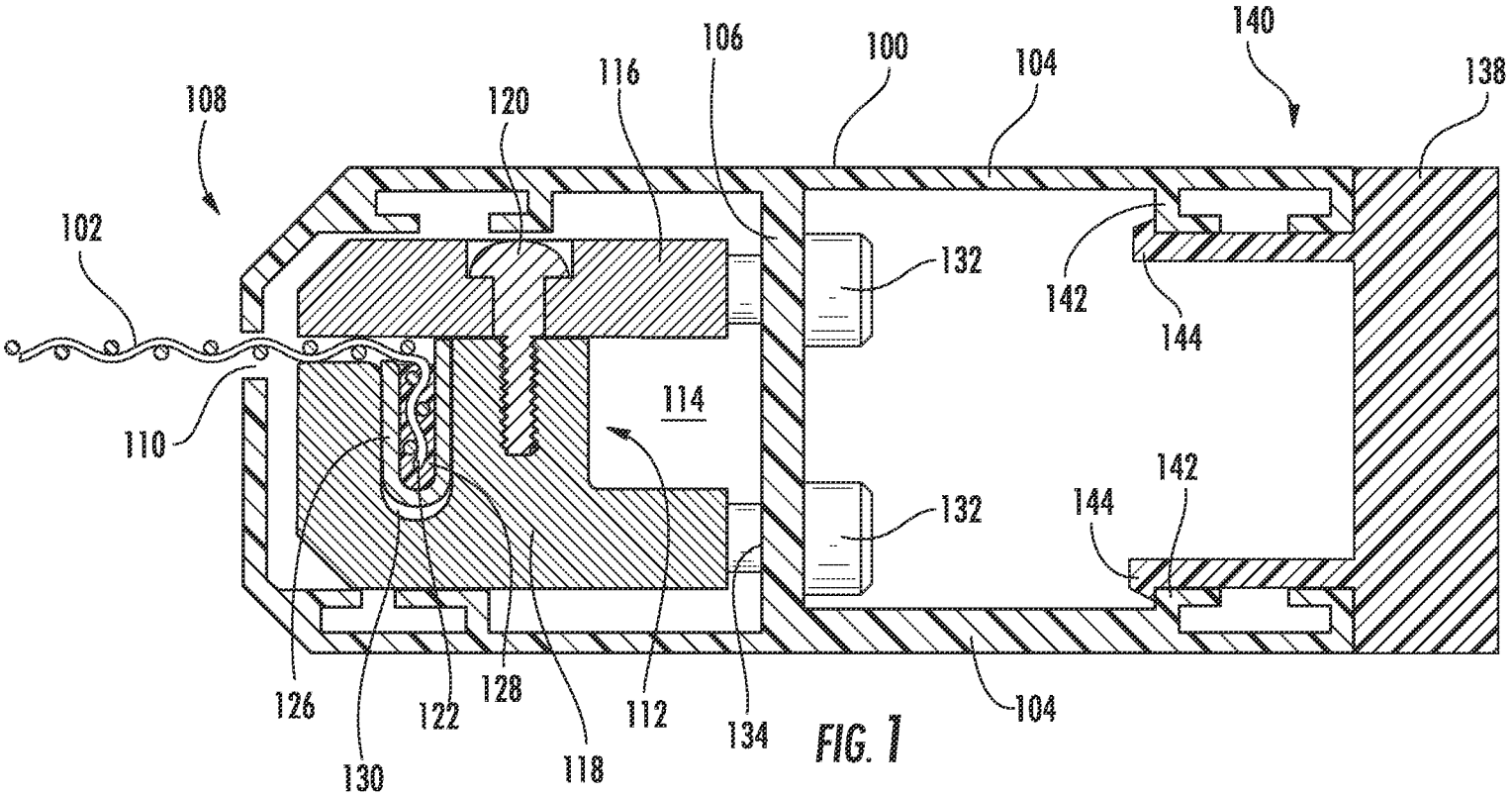
FIG. 1 is a cut away side view of the frame assembly wherein a mesh screen is affixed.
Figure 2:
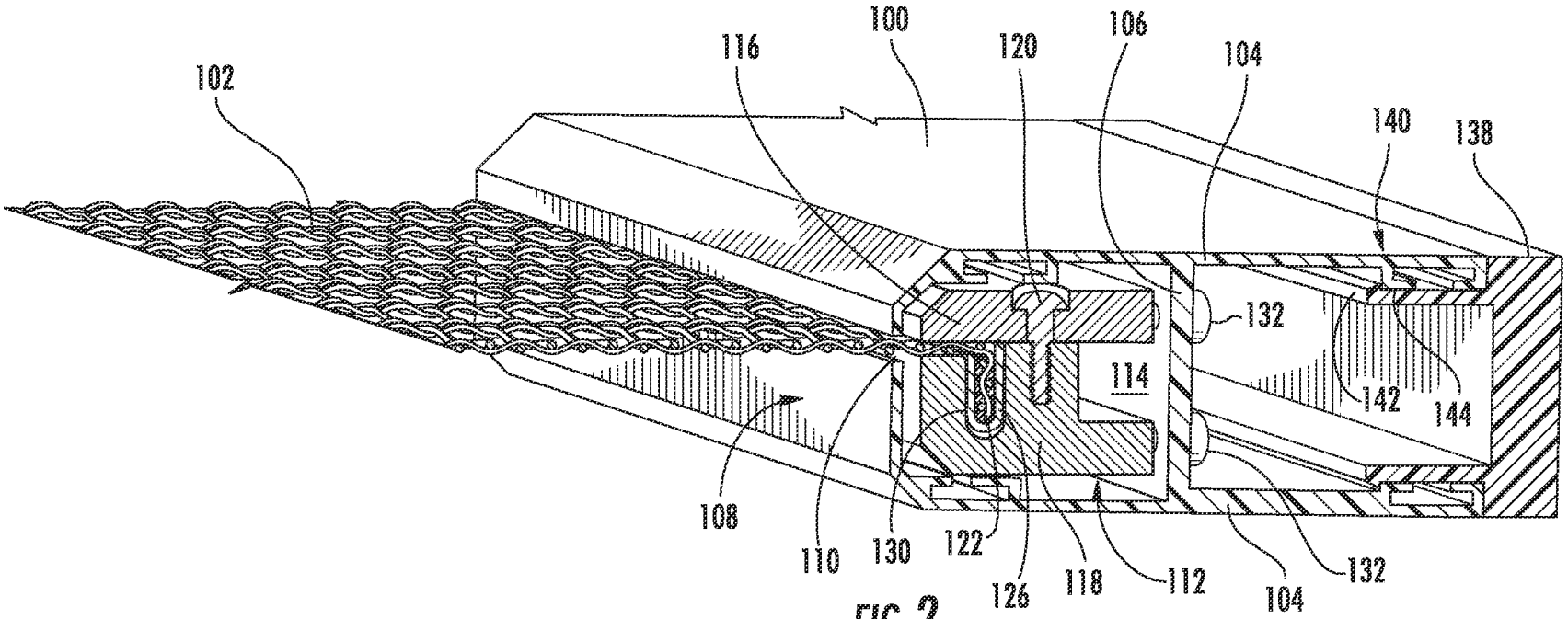
FIG. 2 is a perspective view of the frame assembly of FIG. 1.
Figure 3:
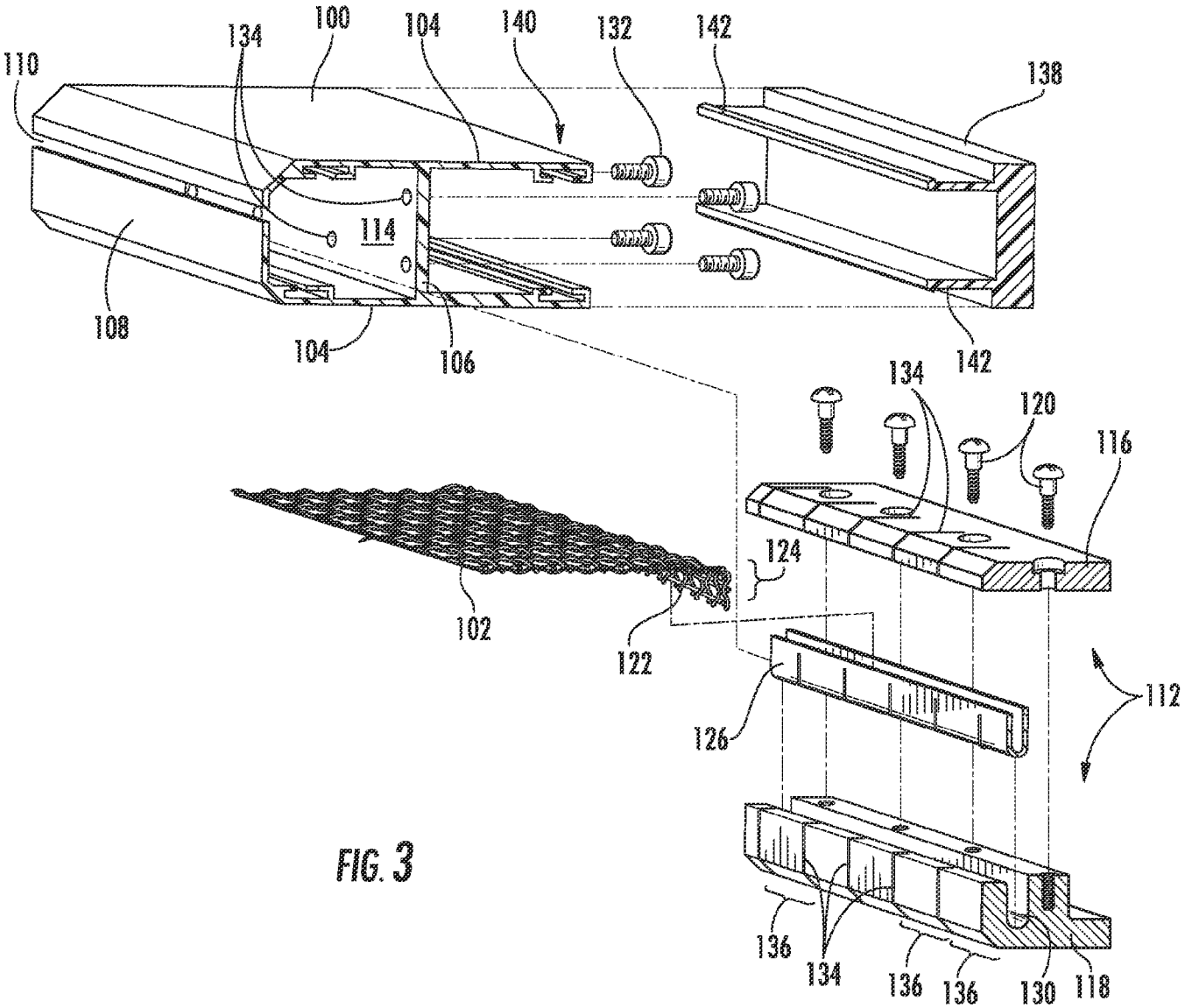
FIG. 3 is an exploded perspective view of the frame assembly of FIGS. 1 and 2.

FIGS. 1-3 illustrate a preferred embodiment of a screen tensioning system having a frame 100 onto which a mesh screen 102 is engaged. Turning first to FIGS. 1 and 2, the frame 100 is defined by two primary regions: two substantially parallel side members 104 connected by a substantially perpendicular connecting member 106, forming roughly an H-beam cross section. Proximate a first region 108 of the frame 100, the side members 104 converge to define a longitudinal slot 110 through which the mesh screen 102 can pass.

With continuing reference to FIGS. 1 and 2 and also FIG. 3, a clamp 112 is slideable into a first compartment 114 defined by the frame 100. The clamp 112 is made from a single piece of material, or alternatively as illustrated made from a top portion 116 and a bottom portion 118. Clamping pressure is adjusted with metal fasteners 120, such as machine screws that pass partially through and engage one of the clamp portions and engage mating threads in the other clamp portion.

The mesh screen 102 is bent proximate an edge 122 of the mesh screen 102 to form a lip 124. The lip 124 fits into a U-shaped channel 126 that is preferably made from the same or similar material type as the mesh screen 102. To permanently secure the lip 124 into the channel 126, an adhesive 128 is placed into the channel 126 and adheres to both the channel 126 and the lip 124. The adhesive 128 is preferably an epoxy.

The channel 126 with the mesh screen 102 adhered engages the clamp 112, and more particularly a slot 130 with the clamp 112. When the clamp 112 is engaged about the channel 126 and mesh screen 102, a screen slot 132 that projects the length of the clamp 112 is defined that permits the mesh screen 102 to pass there through. The screen slot 132 is only large enough to allow the screen to pass through, and does not permit the channel 126 and lip 124 to pass, thereby securing the mesh screen 102 to the clamp 112. Since no metal fasteners such as sheet metal screws are used to attach the mesh screen 102 to the clamp 112, fasteners do not protrude through the mesh screen 102 that could otherwise create a localized source of galvanic corrosion.

As most clearly illustrated by FIG. 3, to assemble the invention, the clamp 112 secured to the mesh screen 102 slides into the first compartment 114 and is secured to the frame 100. Tensioning screws 132 pass through holes 134 in the connecting member 106 and engage mating threads in the clamp 112. The greater the number of rotations the tensioning screws 132 are turned, the closer the clamp is positioned to the connecting member 106. In this manner, tension is applied to the mesh screen 102 by increasing the number of rotations the tensioning screws 132 are turned into the clamp 112.

In order to adjust tension only in local regions of the mesh screen 102 or frame 100, tensioning screws 132 are each adjusted to impart varying degrees of tension. In one embodiment, a plurality of slits 134 are present with the clamp 112. The slits 134 allow an increased degree of movement for individual clamp segments 136, thus providing adjustability of local mesh screen 102 and frame 100 regions. This results in regions of variable mesh screen 102 tension that could not easily be achieved where the clamp 112 was made of a non-segmented construction. The segments 136 may be separate pieces, or alternatively connected regions of the clamp 112, as depicted in the figures herein.

Figure 4:
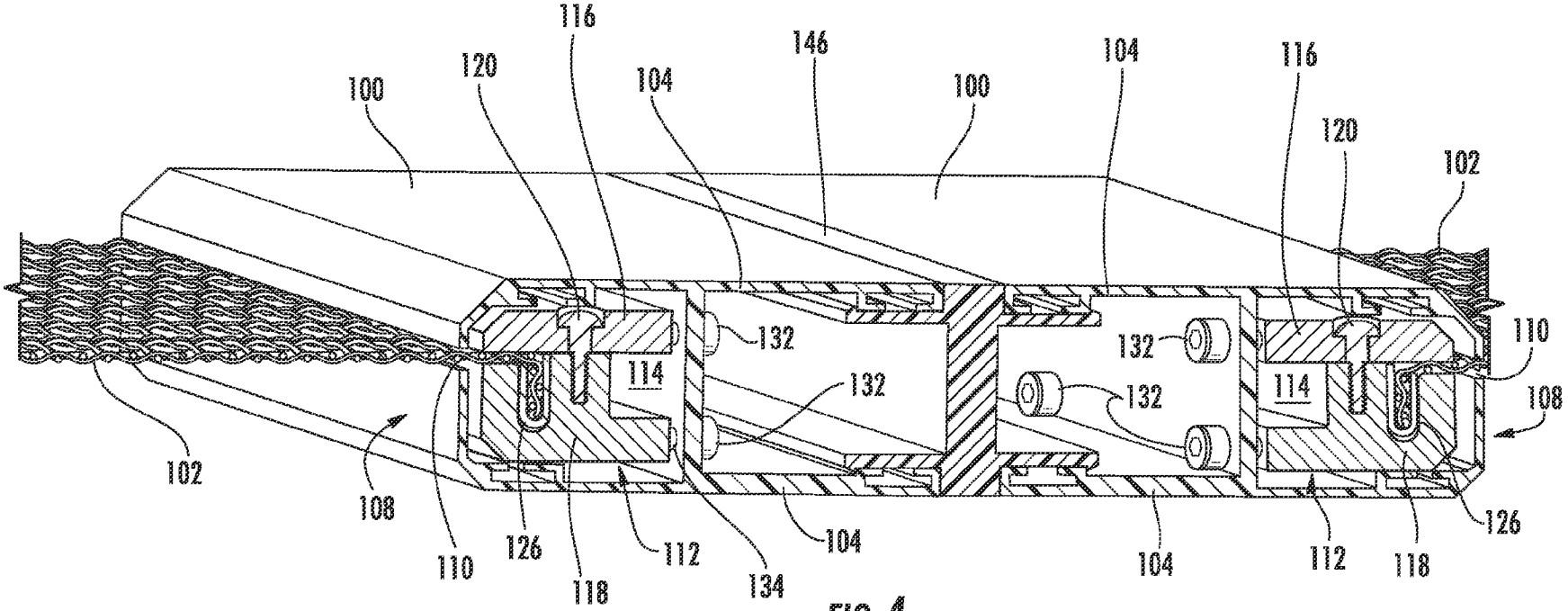
FIG. 4 is a perspective view of an embodiment of a frame assembly.

FIGS. 1-3 also illustrate a sealing member 138. The sealing member 138 engages a second region 140 of the frame 100. The sealing member 138 acts as a decorative cap to hide the internal region of the frame 100, but also may, in another embodiment, provide a weather tight seal for the frame. Barbs 142 with the sealing member 138 engage projections 144 of the frame 100 to secure the sealing member 138 to the frame 100. FIG. 4 illustrates a double sealing member 146 that acts as a weather seal, but also, in another embodiment, a rail to attach two frames 100 to each other. This is used adjoin multiple frame assemblies.

In a preferred embodiment, the mesh screen 102 is made of stainless steel and the U-shaped channel 126 is also stainless steel. Other metals are, however, also contemplated, as are plastics, polymeric compounds, composite materials, and ceramics. The frame 100 and the clamp 112 are preferably aluminum, but stainless steel and other metals are also contemplated.

The invention also contemplates a method for securing and tensioning mesh screen 102 to a frame 100. The method comprises a number of steps: The edge or lip 122,124 of the mesh screen 102 is placed into the channel 126. The channel 126 is then clamped in the clamp assembly 112 that is substantially coextensive with the channel 126. The clamp 112 is slid into the first compartment 114 of the frame 100 and secured to the frame 100. Tension is then applied to the mesh screen 102.

In a related method, adhesive 128 is used to secure the edge 122 of the security screen to the U-shaped channel 126. A plurality of metal fasteners 120 engage the clamp 112 to securely close the clamp. Additionally, the clamp 112 assembly is secured to the frame 100 using metal fasteners 132. The method of securing the mesh screen 102 to the frame 100 may additionally include the step of providing tension to the mesh screen 102 by tightening at least some of the plurality of metal fasteners 132. This makes adjusting the tension at local regions of mesh screen 102 or frame 100 possible for the best fit possible. In a variation of the method of securing the security mesh screen 102 to the frame 100, tension levels are differentially applied along the length of the mesh screen 102.

What is claimed is:

1. A screen tensioning system comprising:

a mesh screen having a lip formed along an edge of the mesh screen, wherein the lip is bent approximately perpendicular to a field of the mesh screen;

a U-shaped channel having an open end, wherein the lip of the mesh screen is secured within the U-shaped channel with adhesive;

a longitudinal clamp having a top portion and a bottom portion, wherein the bottom portion is configured to receive the U-shaped channel and the top portion is configured to fit over the open end of the U-shaped channel and be secured to the bottom portion;

a frame configured to receive the longitudinal clamp therein and the frame having a longitudinal slot along its length and approximately perpendicular to the open end of the U-shaped channel, wherein a width across the longitudinal slot is less than a width of the open end of the U-shaped channel; and a plurality of fasteners disposed on a side of the frame opposing the longitudinal slot of the frame, wherein the plurality of fasteners are configured to move the longitudinal clamp away from the longitudinal slot when rotated in order to apply tension to the field of the mesh screen.

2. The screen tensioning system of claim 1, wherein the adhesive is a metal epoxy.

3. The screen tensioning system of claim 1, wherein the plurality of fasteners are machine screws.

4. The screen tensioning system of claim 1, wherein the clamp defines a plurality of slits that pass substantially through the clamp, the plurality of slits having an orientation perpendicular to a long axis of the longitudinal clamp.

5. A method of securing a security screen to a frame comprising the steps of:

securing an edge of a security screen having a lip formed along an edge of the security screen, wherein the lip is bent approximately perpendicular to a field of the security screen;

clamping the U-shaped channel in a clamp assembly that is substantially coextensive with the U-shaped channel, wherein the lip is secured within an open end of the U-shaped channel with adhesive, and the clamp assembly having a top portion and a bottom portion, wherein the bottom portion is configured to receive the U-shaped channel and the top portion is configured to fit over the open end of the U-shaped channel and is secured to the bottom portion;

sliding the clamp assembly into a frame member having a size and dimension to entrap the clamp assembly; wherein the frame has a longitudinal slot along its length and is approximately perpendicular to the open end of the U-shaped channel, wherein a width across the longitudinal slot is less than a width of the open end of the U-shaped channel;

securing the clamp assembly to the frame member with a plurality of fasteners; and applying tension to the screen, wherein the plurality of fasteners are disposed on an a side of the frame opposing the longitudinal slot of the frame and are rotated to move the clamp assembly away from the longitudinal slot to apply said tension.

6. The method of claim 5 wherein the plurality of fasteners is a plurality of metal fasteners and engages the clamp to securely close the clamp.

7. The method of claim 5 wherein tension levels are differentially applied along the length of the screen.

8. The method of claim 5 wherein the adhesive is epoxy.

* * * * *